US005419699A

United States Patent [19]

Hemsath

[11] Patent Number: 5,419,699

[45] Date of Patent: May 30, 1995

[54] SEAL ARRANGEMENT FOR BATCH COIL ANNEALING FURNACE

[75] Inventor: Klaus H. Hemsath, Toledo, Ohio

[73] Assignee: Indugas, Inc., Toledo, Ohio

[21] Appl. No.: 234,341

[22] Filed: Apr. 28, 1994

[51] Int. Cl.[6] ..... F27B 11/00

[52] U.S. Cl. ..... 432/206; 432/205; 432/254.1

[58] Field of Search ..... 432/206, 254.1, 254.2, 432/242, 152, 183, 205

[56] References Cited

U.S. PATENT DOCUMENTS

| | | |
|---|---|---|
| 1,427,319 | 8/1922 | Peacock . |
| 2,050,029 | 8/1934 | Williams . |
| 2,201,308 | 8/1938 | Edge . |
| 2,964,307 | 11/1956 | Van Dine . |
| 3,112,919 | 10/1960 | Gunow . |
| 3,411,763 | 8/1966 | Blackman . |
| 3,563,522 | 2/1971 | Blackman . |
| 4,846,675 | 7/1989 | Soliman . |
| 5,006,064 | 4/1991 | Freund . |

*Primary Examiner*—Henry A. Bennett

*Assistant Examiner*—Siddharth Ohri

*Attorney, Agent, or Firm*—Frank J. Nawalanic

[57] ABSTRACT

An improved seal arrangement is disclosed for use in batch coil annealing furnaces. The furnace has extending from its base a pair of cylindrical upright supports having exposed membrane engaging seal edges and between which an underpressure chamber is formed. The inner cover which removably rests on the base, has an annular top plate extending radially outwardly from its sidewall adjacent the cover's bottom end. Extending vertically downwardly from the top plate are concentric inner and outer clamp mechanisms which clamp flat annular elastomer seal therebetween. An overpressure chamber is formed between the seal and the top plate and when the inner cover is seated on the base, an underpressure chamber is formed between the seal and the upright supports. A positive pressure is applied to the overpressure chamber and a vacuum is drawn in the underpressure chamber to insure that the seal is forced into sealing contact with the upright engaging surfaces, thus assuring a positive seal of the inner cover with the furnace base.

38 Claims, 5 Drawing Sheets

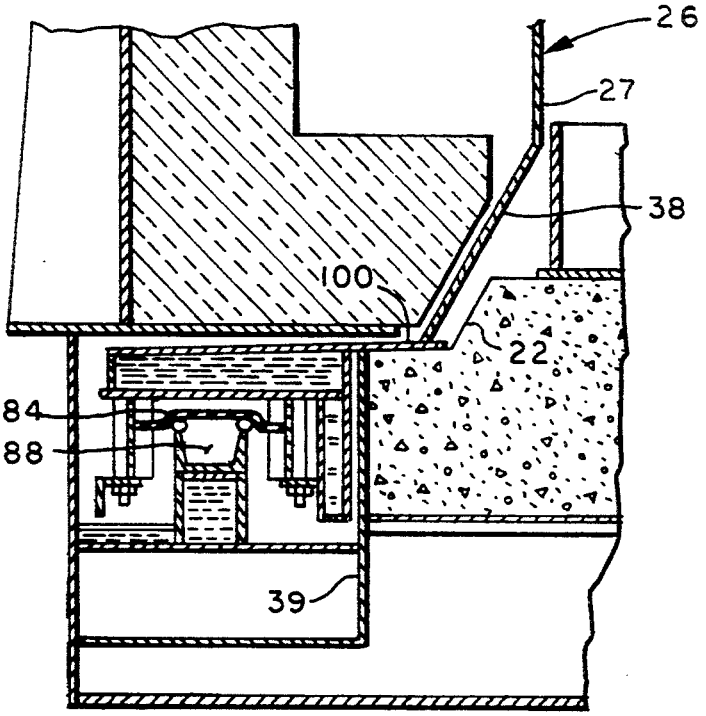
FIG. 4
FIG. 5
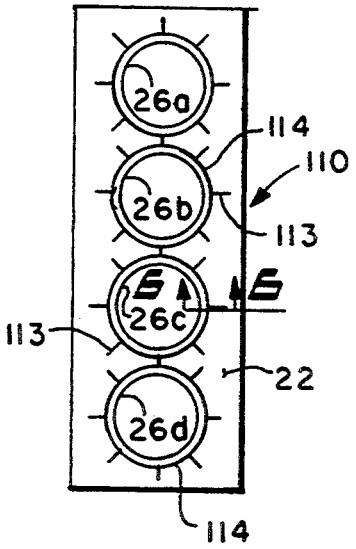
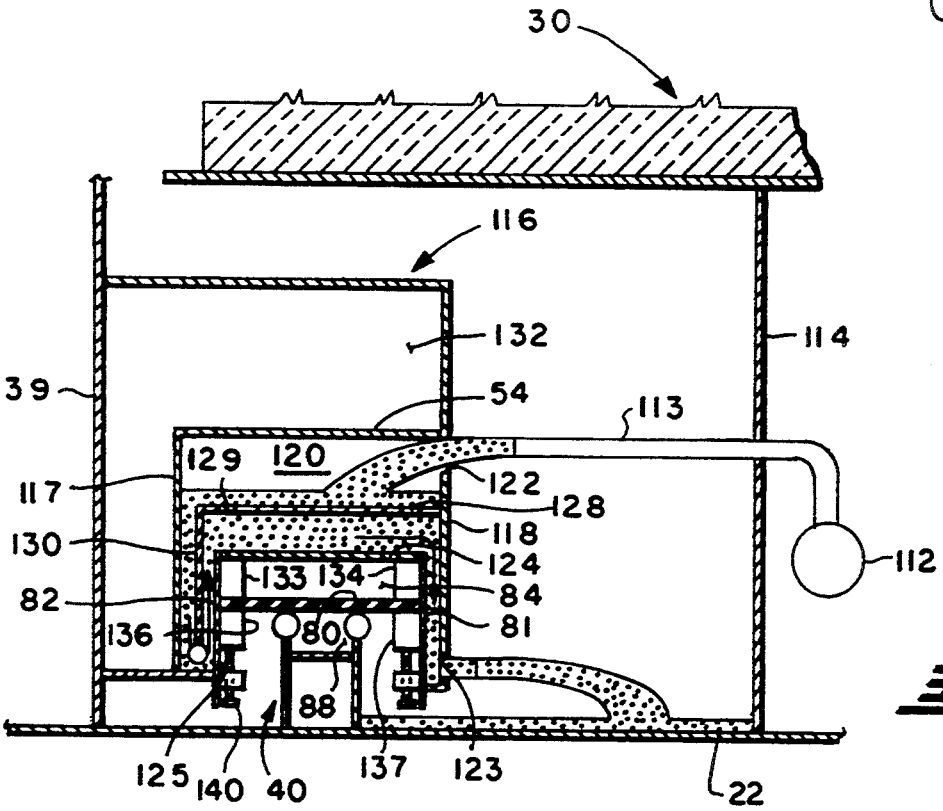
FIG. 6

SEAL ARRANGEMENT FOR BATCH COIL ANNEALING FURNACE

This invention is generally applicable to industrial heat treat furnace and more particularly to a gas seal arrangement employed therein.

This invention is particularly applicable to and will be described with a specific reference to batch coil annealing furnaces and to the arrangement used to effect a seal of the inner cover. However, it will be appreciated by those skilled in the art that the invention is not necessarily limited to annealing metal strip and can be used for any furnace applications employing heat treating atmospheres where an inner cover or an indirectly heated furnace is used to contain and separate the atmosphere.

INCORPORATION BY REFERENCE

The following United States are incorporated by reference:

| | |
|---|---|
| Van Dine | 2,964,307 |
| Blackman | 3,411,763 |
| Blackman | 3,563,522 |
| Freund | 5,006,064 |

In addition, my patent application entitled "Method and Apparatus for Batch Coil Annealing Metal Strip", Ser. No. 051,702, filed Apr. 23, 1993, is also incorporated herein by reference. All documents incorporated do not form part of the present invention but are incorporated so that details of the annealing process and conventional apparatus need not be described herein.

BACKGROUND

Batch coil annealing furnaces (sometimes called "box annealing furnaces" or "bell shaped furnaces") are well known in the industry. Basically, such furnaces comprise a base upon which steel coils are stacked vertically, edge upon edge, and over which a removable inner cover is placed. An outer cover, in turn, is placed over the inner cover. The inner cover is removably sealed to the base. The outer cover contains some form of heat mechanism such as burners or radiant tubes which heat the inner cover which in turn radiates the heat to the work. For cooling, a cooling cover may be employed in place of the outer cover for cooling the inner cover which in turn functions as a heat sink for cooling the work. A fan arrangement within the base circulates a heat treat atmosphere about the coils.

Typically, the heat treat atmosphere within the inner cover has been inert, i.e., substantially nitrogen or, a reducing gas composition such as hydrogen-nitrogen has been used. Still more recently, substantially high hydrogen or high reducing atmospheres have been used as a furnace atmosphere in annealing metal strip for improved strip properties. Still more recently as disclosed in my prior application Ser. No. 051,702, a vacuum can be drawn within the inner cover for purge/-cleansing purposes with a hydrogen gas backfill during the annealing process. The presence of hydrogen (and CO) significantly increases safety concerns should the seal arrangement between the inner cover and the furnace base leak trace amounts of oxygen into the inner cover during annealing or should appreciable amounts of the furnace atmosphere leak out and mix with air.

Initially, sand seals were used to seal the inner cover to the base. The sand seal is nothing more than a trough of sand into which the bottom edge of the cylindrical inner cover is placed. Sand seals are not acceptable should the furnace atmosphere contain any significant quantities of hydrogen.

Accordingly, the prior art has developed several elastomer seal arrangements to effect an improved sealing between the inner cover and the base. The seals are typically water cooled to prevent thermal deterioration of the seal. Examples of such arrangements can be found in U.S. Pat. Nos. Van Dyne 2,964,307; Blackman 3,411,763; Blackman 3,563,522; and Freund 5,006,064. All of these arrangements use the weight of the inner cover to compress the elastomer seal and in the process of compression effect sealing between the inner cover and the outside. Some arrangements also use mechanical clamps. Such elastomer seal arrangements are initially acceptable for slight, positive pressure application but eventually deteriorate and erode. They are not acceptable should a vacuum be drawn in the inner cover.

A conventional prior art elastomer seal applied to a batch coil annealing furnace is schematically illustrated in FIG. 1. In that arrangement, inner cover 1, insulated by Kaowool affixed to outer cover 3, rests on furnace base 4. Extending from inner cover 1 is a solid, annular elastomer seal 2 which seats on and is compressed by an annular ledge 11 extending from base 4. That is the weight of inner cover 1 compresses elastomer seal 2 against annular ledge 11 to make a seal. An insulating base trough 6 carries a water coolant connected through base couplings from a water supply in base 4. In addition, a trough 8 carrying water or oil is formed with annular ledge 11 in base 4 as shown and additionally acts as a liquid seal. This prior art arrangement is acceptable for slight positive pressure applications. It suffers from the defects discussed above which afflict other prior art elastomer seals. The weight of the inner cover results in an imperfect seal. The elastomer deteriorates and erodes in time. The liquid seal is not acceptable for vacuum applications.

Alternatively, liquid seals have been used for typical, slight positive pressure application. A double liquid prior art seal arrangement is disclosed in FIG. 1A. In that arrangement, inner cover 1 insulated by Kaowool affixed to outer cover 3 rests on furnace base 4. Extending from inner cover 1 is a first circular seal plate 5 which makes an imperfect sealing contact with an insulating material formed in an insulating base trough 6. Next, a second circular plate seal 7 forms a liquid seal with an oil trough 8. Finally, a third circular plate seal 9 forms a liquid seal with water trough 10. This seal arrangement is fairly effective for positive pressure systems but, of course, will not work should a vacuum be drawn within the inner cover. Also, there are problems inherent in any liquid seal arrangement should positive pressures within the inner cover significantly vary.

Finally, in my prior application Ser. No. 051,702, I disclose a unique water cooled elastomer seal arrangement which can basically be described as a pair of concentric circular O-rings with a vacuum drawn in the annular space between the O-rings to effect a seal. This is a more effective arrangement than the prior art discussed above since the vacuum and not the cover establishes the sealing force and should an oxygen leakage occur at the outer seal, the vacuum functions to draw the oxygen away from the system so that it does not inadvertently enter into the inner cover.

The elastomer seal must be protected against thermal and mechanical deterioration. Thermal protection is provided by cooling both flanges with water. Mechanical protection is more difficult. A lubricating grease is normally used to facilitate relative movement between flange sealing surfaces, preventing tearing of O-ring surfaces and compression. The grease attracts and retains dirt and debris and the dirt may cause leakage. If hot gases escape under pressure from the inner cover local face, temperatures of the seal can exceed safe levels and a catastrophic failure can occur. Should substantially pure hydrogen atmosphere be used, the inner cover may very well behave as a rocket. O-rings are, therefore, subject to premature failure. (This invention discloses a novel sealing arrangement that uses a dry diaphragm or membrane gasket rather than a greased O-ring. As such, it can replace all previously used seals of sand, ceramic, elastomer gaskets, and o-rings.)

Insofar as the specific application of liquid seals to the inner cover of batch coil annealing furnaces is concerned, there typically is provided high pressure, water cooling of the seal by means of a high pressure (in the area of 35–45 PSI) water line connected from the seal area (i.e., the inner cover) to the plant's water supply by means of a flexible metal or elastomer hose and, of course, a coupling connection. The coupling connection has to be made and broken whenever the inner cover is positioned on or removed from the stand. This means that the base and connection is subjected to heat and pressure which in turn can and does cause failures.

Insofar as the broader aspects of the invention are concerned, heat treat furnaces in general have doors with a variety of seal arrangements. Positive pressure heat treat furnaces have locking rings which cam the door into sealing engagement with the furnace enclosure. Vacuum furnaces typically use the vacuum drawn within the furnace to seal an elastomer seal extending above the door. The elastomer seals are water cooled. In general, the seals have to have carefully machined, water cooled surfaces between door and furnace enclosure to provide a positive seal.

SUMMARY OF THE INVENTION

Accordingly, it is a principal object of the present invention to provide an elastomer membrane seal arrangement which specifically assures long life and positive sealing of the inner cover in a batch coil annealing furnace, but in a more general sense assures leak tight sealing of any furnace enclosure.

This object along with other features of the invention is achieved in its primary application to a batch coil annealing furnace which has an annular base plate with an upright annular chamber formed or extending therefrom. An inner cover having a cylindrical side wall with an open base is provided with an annular top plate extending radially outwardly relative to the side wall adjacent the cover's base. An outer cover receives the inner cover and the outer cover and inner cover rest on the furnace's base. An annular, elastomer membrane seal having an inside edge and an outside edge is provided and a clamp arrangement associated with the top plate is provided for clamping the membrane seal adjacent its inner and outer edges to form a first over pressure chamber extending between the top plate and the seal. A valve is provided to pressurize the over pressure chamber with inert gas at a pressure $P_1$. The upright channel has exposed seal engaging edges which are adapted to contact the underside of the seal when the inner cover rests on the base and the channel forms a second pressure chamber with the seal. A second valve arrangement in fluid communication with the second chamber is provided for placing the second chamber at a second pressure $P_2$ which conveniently is at a vacuum so that a pressure differential results between $P_1$ and $P_2$ to force the membrane to distend or wrap itself about the engaging edges to form a superior seal which has long life because the pressure differential automatically compensates for elastomer wear.

In accordance with a further feature of the invention, the pressure within the inner cover is established at $P_3$ and the seal pressures are regulated such that $P_1$ is greater than $P_3$ and $P_3$ is greater than $P_2$ so that the seal can effectively operate whether the inner cover is at positive pressure or placed under a vacuum.

In accordance with another aspect of the invention, a control arrangement to maintain the safety and the seal integrity of the furnace is provided by placing a vacuum pump in fluid communication with the second underpressure chamber and a pressure sensor in fluid communication with the first overpressure chamber. An oxygen sensor senses the presence of any oxygen in the second underpressure chamber and additionally, an oxygen sensor can be provided within the inner cover.

In accordance with another aspect of the invention, the clamp arrangement includes inner and outer concentric circular bottom plates with each plate having a plurality of openings. A threaded stud extends through each opening for threaded engagement with the top plate and each stud receives a sleeve positioned between the top and bottom plate so that the bottom plate is maintained at a spaced predetermined distance from the top plate. The cylindrical top inner clamp plate has an annular edge in contact with the top plate and a similar bottom inner clamp plate has an annular edge in contact with the bottom plate and the membrane seal's inner edge is clamped between the bottom and top inner clamp plate edges. A similar arrangement is provided for clamping the outer edge of the membrane with the height of the inner top and bottom clamp plates being slightly less than the length of the sleeves so that the membrane's inner and outer edges are compressed and securely sealed against leakage by the clamps while avoiding application of clamping force which would otherwise damage the membrane. Alternatively, the clamp arrangement can conceptually comprise a rolled ring which is pressed against the membrane and which has a well defined depth. The membrane is compressed to a predetermined percentage of its original, unsaturated thickness by measuring the ring's distance from a previously measured edge or inscribed line and controlling the membrane's distortion by the pressure differential.

In accordance with a specific and somewhat separate aspect of the invention, the annealing stand base is provided with a plurality of permanently fixed, or stationary, free standing water lines which are positioned a fixed distance from each inner cover when the inner cover is set on the base. Each inner cover has an open reservoir on top of each seal which is filled by water from low pressure water jets emanating from each water line. The water flows completely by gravity from the reservoir along a U-shaped path surrounding the membrane and simply flows out openings adjacent the bottom of the inner cover so that a low pressure water supply cools the seal without having to make any water connection between the base and inner cover.

In accordance with a more general aspect of the invention, conceptually the seal of the invention can be used to seal the vertically hinged door of a heat treat furnace by using an annular seal member carried on the door, a ring carried on the furnace opening having seal engaging edges and applying a pressure differential as defined above to cause the seal to distend about the ring's engaging edges. Alternatively, the seal can be mounted to the furnace opening and the engaging edges affixed to the door so that the seal distends about the engaging edges in the door.

In accordance with a still further aspect of the invention, an improvement is provided for batch coil annealing furnaces by means of an annular top plate adjacent the bottom of the inner cover and extending radially outwardly from the inner cover side wall. First and second generally circular clamps concentric with one another and extending downwardly from the top plate are provided for clamping an annular elastomer membrane seal between the first and second clamps so that the seal clamps, top plate, and seal membrane define an overpressure, sealed chamber. The overpressure, sealed chamber is provided with a valve mechanism to be in fluid communication with a source of pressurized inert gas and to be pressurized thereby. First and second circular supports extend upwardly from the base and terminate in seal engaging edges with the first support spaced radially outwardly from the first clamp and the second support spaced radially inwardly from the second clamp and forming an upright annular chamber therebetween with the underside of the seal membrane when the inner cover rests on the base. The supports are water cooled from beneath.

It is thus an object of the invention to provide a positive elastomer seal for any furnace which uses a pressure differential across the seal to maintain two separate atmospheres and compositions while stretching the seal a predetermined amount to insure a positive seal.

It is another specific object of the invention to provide a positive elastomer seal for the inner cover of a batch coil annealing furnace which uses a pressure differential to maintain two separate atmospheres of a predetermined composition while also stretching the elastomer seal a predetermined amount into positive sealing instead of relying on the weight of the inner cover to establish elastomer sealing.

It is still another object of the invention to provide a seal arrangement for use in a furnace utilizing a pressure differential across the face of a flat, elastomer seal which automatically compensates for seal wear to extend the seal life.

It is another object of the invention to provide an inner cover seal for a batch coil annealing furnace which permits the batch coil annealing furnace to safely operate with a hydrogen or explosive furnace atmosphere.

It is still yet another object of the invention to provide a seal for the cover of bell shaped furnaces which effectively operates to permit the furnace to operate under both positive pressures and/or a vacuum.

A still further important object of the invention is to provide improved water cooling for the elastomer seal and the seal engaging edges of the inner cover of a batch coil annealing furnace.

A still further object of the invention is to provide a pressurized membrane seal whereby the pressure differential across the seal causes the membrane to wrap itself about one or a pair of seal engaging lips to produce a superior seal which pressure compensates for elastomer wear to make the seal long-lasting.

Another object of the invention is to eliminate water carrying hose and hose connectors from the seal and seal edges in a batch coil annealing furnace type application by replacing the bases and hose connectors with free standing coolant jets.

Still yet another important object of the present invention is to provide a seal arrangement and a control system for use therewith which is able to pinpoint where leakage within the furnace occurs.

A still more specific, but important object of the invention is to provide a seal and a coolant arrangement which permits a substantially pure hydrogen atmosphere to be safely used in a multi-stand batch coil annealing furnace.

Still another feature of the invention is to provide an elastomer seal for the inner cover of a batch coil annealing furnace which is sized and positioned to fit conventional batch coil inner covers for retrofit applications.

A still further object of the invention is to provide a seal and coolant arrangement which can be retrofitted to existing multi-stand batch coil annealing furnaces.

A still further object of the invention is to provide a simple and inexpensive elastomer seal for the inner cover of a batch coil annealing furnace.

A still further general object of the invention is to provide an improved elastomer seal for any furnace application in which an opening of an enclosure must be sealed in a resealable manner.

These and other objects of the present invention will become apparent to those skilled in the art upon reading and understanding the detailed description of the invention set forth below.

BRIEF DESCRIPTION OF THE DRAWINGS

The invention may take form in certain parts and arrangement of parts a preferred embodiment of which will be described in detail below and shown in the accompanying drawings wherein;

FIG. 4 is a view similar to FIG. 2 but showing the seal arrangement applied to another conventional inner cover;

FIG. 5 is a schematic, plan view of a multi-stand batch coil annealing furnace employing a hoseless, water cooling arrangement;

FIG. 6 is a view similar to FIGS. 2 and 3 taken along lines 6–6 of FIG. 5 showing, in greater detail the hoseless connection for cooling the seal of the present invention.

DETAILED DESCRIPTION OF THE INVENTION

Figure 2:
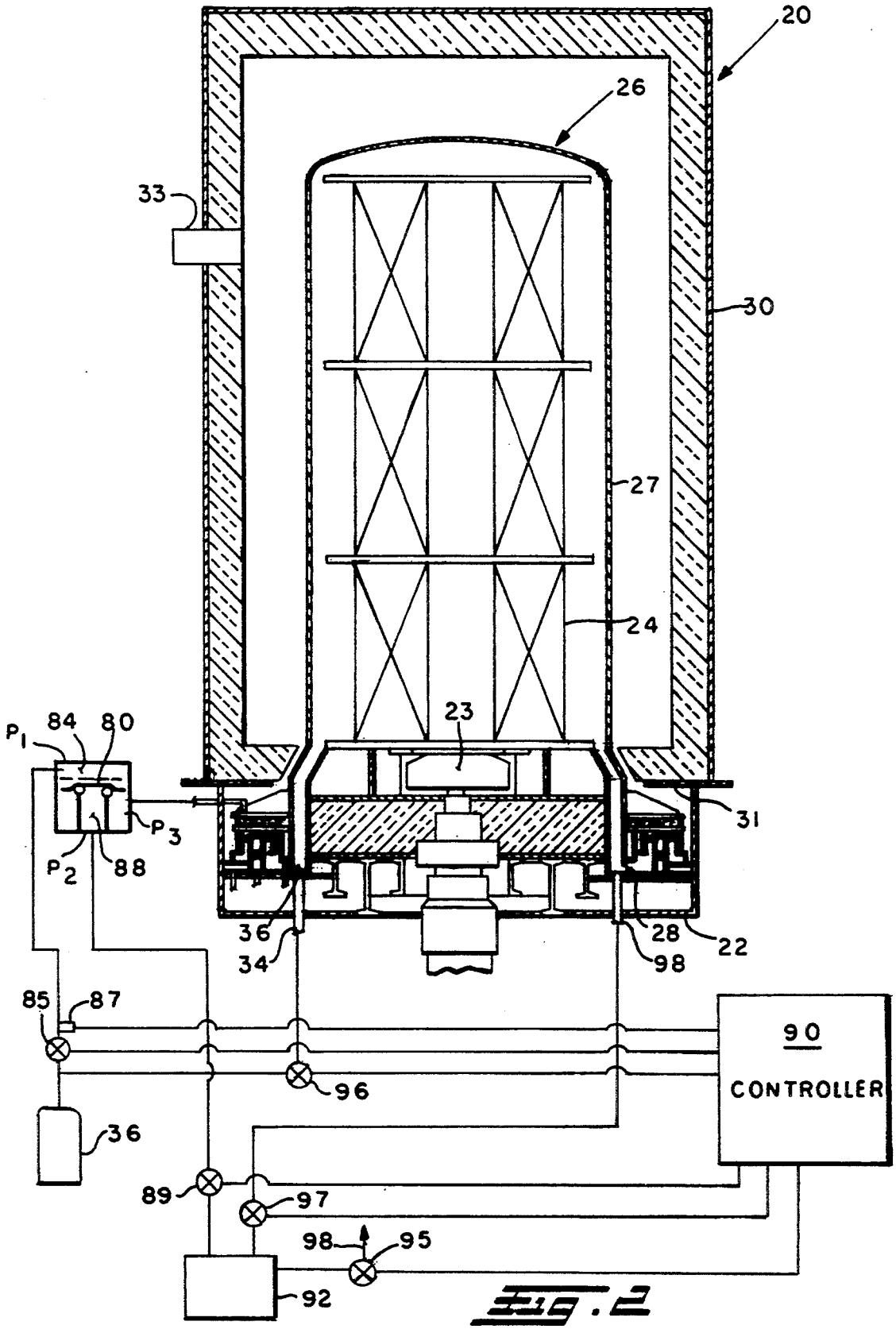
FIG. 2 is a schematic, vertically-sectioned view batch coil annealing furnace similar to FIG. 1 employing the present invention.

Referring now to the drawings wherein the showings are for the purpose of illustrating a preferred embodiment of the invention only and not for the purpose of limiting the same, there is shown in FIG. 2 a batch coil annealing furnace 20 which includes a base 22 containing a centrally positioned fan 23. Coils of wound metal strip designated by reference numeral 24 are vertically stacked on base 22 in a conventional manner. A removable inner cover 26 having a cylindrical sidewall 27 and an open bottom 28 fits over coils 24 and is sealed at its bottom 28 with base 22. A removable outer cover 30 has a flanged bottom 31 which fits over inner cover 26 and rests on base 22 at its bottom 31. Outer cover 30 usually carries the heating mechanism such as a gas fired burner schematically shown as reference numeral 33 which heats inner cover 26 which in turn heats work 24. A gas inlet 34 is provided for injecting a source of gas 36 as a furnace atmosphere which is circulated by fan 23 within inner cover 26. It is to be understood that only one source of gas 36 is shown but that, in practice, source of gas 36 will be either substantially inert, such as nitrogen, or, during annealing (following purge), the gas can be substantially hydrogen or the gas can be a reducing mixture of hydrogen and carbon monoxide mixed with various percentages of basically inert gases, depending upon the particular process which is being performed on work 24. As thus far described, batch coil annealing furnace 20 is conventional.

Figure 3:
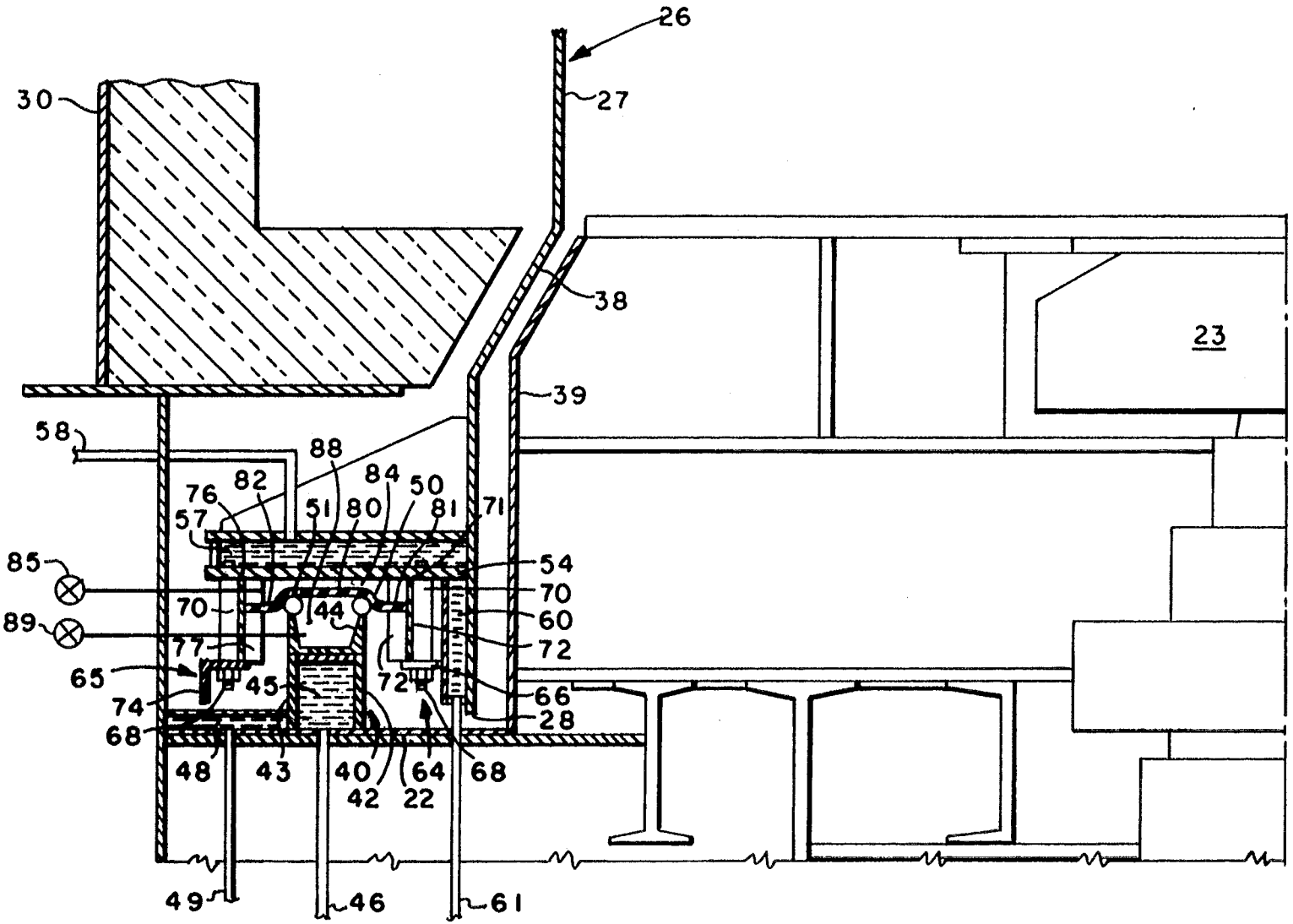
FIG. 3 is a partial, vertically sectioned view of the peripheral portion of the furnace illustrated in FIG. 2.

Referring now to FIGS. 3 and 4, cylindrical sidewall 27 of inner cover 26 typically has a frusto-conical section 38 flaring radially outwardly adjacent its open bottom 28. Depending on the inner cover design, open bottom 28 can have various configurations. In all instances, open bottom 28 can be viewed as having a radially-outwardly extending flange which flange is removably sealed to base 22. In the preferred embodiment, shown in FIGS. 3 and 4, open bottom 28 simply comprises a cylindrical wall portion 39 extending downwardly from frusto conical wall portion 38. In the applied position of inner cover 26, open bottom 28 does not contact base 22 for reasons which will be discussed hereafter.

As best shown in FIG. 3, the seal arrangement of the present invention includes an upright support, generally designated by reference numeral 40, extending vertically upwards from base 22. In the preferred embodiment, upright support 40 can be fabricated from an inner cylindrical plate 42 and a radially outward positioned cylindrical plate 43 concentric with inner plate 42. Inner and outer plates 42, 43 are welded at their bottom edges to base 22 and are covered at their top edges by a circular channel shaped member 44 which is welded thereto. The space captured between inner and outer plates 42, 43, base 22 and channel shaped member 44 can comprise an upright support water jacket 45 into which a coolant is flowed through an inlet 46 and exhausted from an outlet (not shown) for cooling purposes. Also provided for seal arrangement is a water trough 48 through which a coolant is likewise flowed from an inlet 49 to an outlet (not shown). At the upper edges of channel shaped member 44 are formed inner and outer seal engaging surfaces 50, 51 respectively. As shown, inner and outer seal engaging surfaces 50, 51 are shaped as circular beads to provide a good bearing surface. It should be noted that the furnace or inner cover atmosphere flows down between inner cover 26 and past inner cover open bottom 28 but is dead ended at inner plate 42, channel shaped member 44 and inner sealing engaging surface 50, as will be explained further hereafter.

Extending radially outwardly from and adjacent to but vertically spaced from open bottom 28 of inner cover 26 is an annular top plate 54 which is welded to cylindrical wall portion 39. A plurality of circumferentially spaced gusset plates rigidize top plate 54 so that it has sufficient strength to carry the weight of inner cover 26. Formed over the top surface of top plate 54 is a top plate water jacket 57 through which a coolant is circulated from an inlet 58 to a diametrically opposed outlet (not shown). Also, immediately below top plate 54 and adjacent cylindrical wall portion 39 of inner cover 26 is an inner cover water jacket 60 through which coolant is also flowed from an inlet 61 to a diametrically opposed outlet (not shown).

Extending downwardly from top plate 54 is an inner clamp arrangement designated generally by reference numeral 64 and spaced radially outwardly therefrom and concentric therewith is an outer clamp arrangement indicated generally by reference numeral 65. Inner clamp arrangement 64 is spaced radially inwardly of inner sealing engaging surface 50 and outer clamp arrangement 65 is spaced radially outwardly from outer seal engaging surface 51.

Inner clamp arrangement 64 includes an inner bottom annular plate 66 having a plurality of openings through which a like plurality of threaded fasteners or studs 68 extend. Studs 68 screw or are threaded into circumferentially spaced openings in top plate water jacket 57 and receive or are inserted into tubular spacers 70 so that spacers 70 are clamped between top plate 54 and inner bottom annular plate 66 when studs 68 are tightened. Also, sandwiched between inner bottom annular plate 66 and top plate 54 is a top inner clamp plate 71 which is welded at its top edge to top plate 54. Similarly, a cylindrical bottom inner clamp plate 72 is secured at its bottom edge to inner bottom annular plate 66. The height of top and bottom inner clamp plates 71, 72 together is slightly less than the length of spacers 70 so that a predetermined space exists between the confronting edge surfaces of top and bottom inner clamp plates 71, 72. A similar arrangement is provided for outer clamp arrangement 65. An outer bottom plate 74 is secured by studs 68 to top plate 54 clamping spacers 70 therebetween. Similarly, a cylindrical outer top clamp plate 76 is secured to top plate 54 and a cylindrical outer bottom clamp plate 77 is secured to outer bottom clamp plate 77.

An annular elastomer seal 80 in the form of an annular membrane or diaphragm is provided. Elastomer membrane seal 80 can be formed of any rubber compound conventionally used in the furnace art for door seals, i.e., vacuum furnace door seals, although compounds such as natural rubber and neoprene are contemplated. Elastomer membrane seal 80 has an inner edge portion 81 and an outer edge portion 82. Inner edge portion 81 is clamped between top inner clamp plate 71 and bottom inner clamp plate 72 and outer edge portion 82 is clamped between outer top clamp plate 76 and outer bottom clamp plate 77. Elastomer membrane seal 80 will typically have a thickness of about $\frac{1}{4}$–$\frac{3}{8}$" and will easily fit, for assembly purposes, into the space provided between clamp plates 71, 72 and 76, 77. As studs 68 are tightened, inner and outer edge portions 81, 82 become compressed by the clamp plates until spacers 70 contact top plate 54. Inner and outer edge portions 81, 82, in fact, will distend or be compressed such that membrane seal's nominal thickness will be reduced by about 50%. As will be appreciated by those skilled in the art, the clamp arrangement must sufficiently compress seal 80 adjacent its inner and outer edge portions 81, 82 to insure an air tight seal, but seal 80 cannot be compressed to the point where it may be prone to failure, such as by tearing.

As thus assembled, the space between the underside surface of top plate 54, the top side surface of membrane seal 80, top inner clamp plate 71 and outer top clamp 76 defines a sealed first overpressure chamber 84. A valve 85 is provided to be in fluid communication with overpressure chamber 84. In the invention's simpler form, valve 85 can be viewed simply as a tire valve through which an inert gas, nitrogen, is injected to pressurize overpressure chamber 84 to a pressure of about 15–30 PSI. Overpressure chamber 84 can then be viewed as an innertube or tubeless tire which, when inner cover 26 is lowered onto base 22, engages inner and outer sealing engaging surfaces 50, 51. In its simpler form, the weight of inner cover 26 is sufficient to deform or shape membrane seal 80 about inner and outer sealing engaging surfaces 50, 51 such that a seal can be formed therebetween, although the weight of inner cover 26 will increase the pressure of the gas within overpressure chamber 84 above 30 PSI. It is also noted that in the preferred embodiment shown in FIG. 3, the length of cylindrical wall portion 39 of inner cover 26 is sized to contact base 22 should there be no pressure in overpressure chamber 84. In that instance, upright support assembly 40 would also contact top plate 54.

Figure 1:
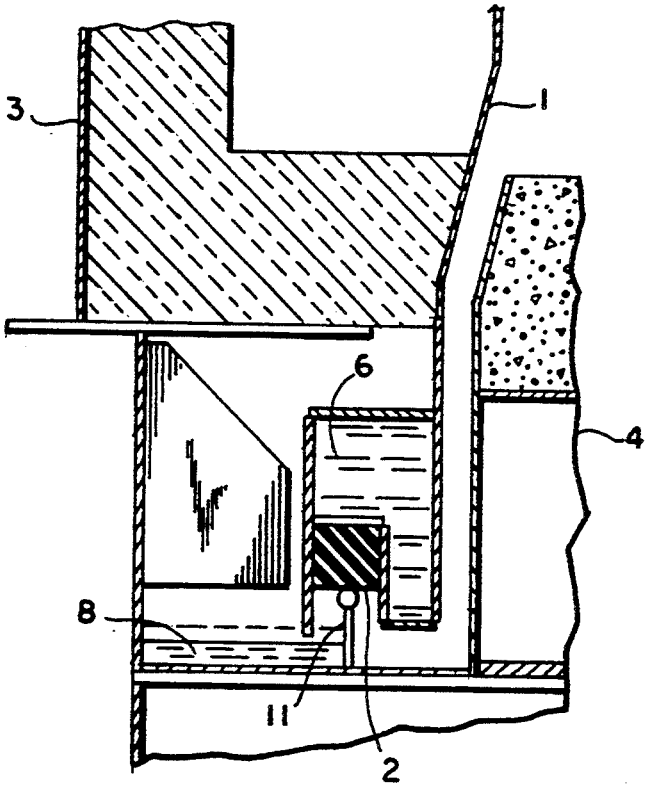
Fig. 1 PRIOR ART
FIG. 1 is a partial, vertically-sectioned view of the peripheral portion of a batch coil annealing furnace showing a prior art sealing arrangement.
Figure 1A:
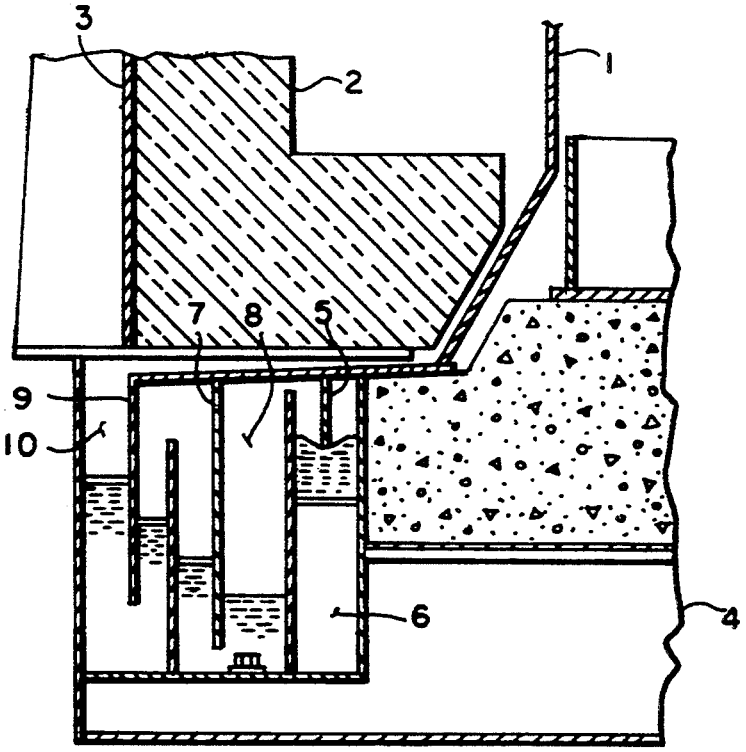
Fig. 1A PRIOR ART
FIG. 1A is a view similar to FIG. 1 but showing a different prior art seal.

While the seal arrangement of the present invention can function in the manner discussed, for stability purposes as well as increased sealing capabilities, an additional pressure chamber is provided. When membrane seal 80 contacts inner and outer sealing engaging surfaces 50, 51 an underpressure chamber 88 is formed within channel shaped member 44, i.e., that is within upright support assembly 40. The invention specifically contemplates that a vacuum or underpressure is pulled in underpressure chamber 88 by means of metering valve 89. The combination of the pressure of the inert gas in overpressure chamber 84 pushing membrane seal 80 down into inner and outer sealing engaging surfaces 50, 51 plus the vacuum within underpressure chamber 88 pulling membrane seal 80 about inner and outer sealing engaging surfaces 50, 51 force membrane seal 80 to closely conform and adhere to the shape of inner and outer sealing engaging surfaces 50, 51. This provides a high sealing force preventing any leakage of gas through inner and outer sealing engaging surfaces 50, 51 while also rigidizing, almost clamping, inner cover 26 to base 22 and is one of the essential underpinnings of the invention. Furthermore, should the elastomer of membrane seal 80 simply wear or become harder as it ages, the pressure differential still forces the membrane about sealing engaging surfaces 50, 51 making for a long life seal. At the same time, depending on the inner cover design (for example, a retrofit of the prior art seal arrangement shown in FIG. 1A), the weight of inner cover 26 can be taken by the base so that the inner cover does not have to be loaded onto the seal arrangement provided a vacuum is drawn within underpressure chamber 88. Pumping a positive pressure into overpressure chamber 84 and drawing a vacuum in underpressure chamber 88 (or alternative, simply making the pressure, $P_1$, in overpressure chamber 84 greater than the pressure, $P_2$, in underpressure chamber 88) will effect the desired sealing. Accordingly, insofar as the cover design is concerned, open bottom 28 could be extended in FIG. 3 to contact base 22 so that the weight of inner cover 26 is taken by cylindrical wall portion 39.

Referring now to FIG. 2, the seal arrangement described makes it possible to provide a positive detecting or sensing control mechanism with fail-safe features which constantly assures, unlike prior art seals, the integrity of the seal system during furnace operation. In its simplest form, the pressure in overpressure chamber 84 is sensed by a pressure transducer 87 and its signal monitored by a controller 90. Should a leak in membrane seal 80 occur, pressure in overpressure chamber 84 will fall and controller will actuate valve 85 to increase or to supply inert gas 36 to overpressure chamber 84. Thus, the leak will result in the injection of an inert gas, nitrogen, into inner cover 26.

At the same time, a vacuum pump 92 has metering valve 89 under the control of microprocessor controller 90 to pull a set vacuum in underpressure chamber 88. An oxygen detector 95 shown as part of a valve vented to atmosphere connected to vacuum pump 92 and under the control of microprocessor controller 90 can detect whether any oxygen leakage has occurred. In the event of failure, microprocessor controller 90 will actuate metering valve 89 to maintain the vacuum within underpressure chamber 88. As a consequence, any air which might be leaking past outer seal engaging surface 51 will be drawn into the vacuum line membrane seal 80. As disclosed in my prior pending patent application, should there be any leakage of hydrogen into underpressure chamber 88, the fact that there is a vacuum will prevent the mixture from being combustible so that appropriate provisions can be made to dilute the mixture with nitrogen in the vacuum pump trap, etc. It should also be remembered that in the event of seal rupture, while vacuum pump 92 is effective to draw any oxygen into underpressure chamber 88, inert gas 36 is being supplied to inner cover 26 through overpressure chamber 84 preventing oxygen from entering inner cover 26. Thus, there is dual protection against oxygen entering inner cover 26 to ruin the steel being processed therein.

In normal operating conditions, the pressures are set by controller 90 and are at steady state. If the inner cover is operated under normal conditions at a slightly positive pressure, $P_3$, then the pressure in overpressure chamber 84, $P_1$, is established to be always greater than inner cover pressure, $P_3$, and the pressure within underpressure chamber 88, $P_2$, is always established to be less than the pressure within inner cover 26. This holds even if undercover 26 is operated at a vacuum and it is, of course, a feature of the invention that the seal arrangement can be used universally, whether or not a vacuum is drawn within inner cover 26 or positive pressure is present. In accordance with the theory of the invention, positive pressure, $P_2$, can exist within underpressure chamber 88. In practice, a vacuum is drawn for fail-safe reasons, as discussed above.

The system, as thus far described, can be used to monitor the seal effectiveness for replacement purposes. As noted, the sealed condition results in a steady state positive pressure, $P_1$, in overpressure chamber 84 and a steady state vacuum, $P_2$, in underpressure chamber 88. If elastomer membrane seal 80 wears the pressures, $P_2$, $P_1$, required to maintain steady state will vary with time, and thus, by keeping track or record of the pressure changes, a basis can be established as to when membrane seal 80 should be placed. Further, in the event that there is a leak measured by pressure changes, but no oxygen is sensed by oxygen detector 95, it is known that the leak is occurring about inner sealing engaging surface 50, whereas, should a leak develop with oxygen being detected, by oxygen detector 95, it is known that a leak has developed at outer seal engaging surface 51 (valves 89, 97 under control of controller 90 can be regulated to identify the source of oxygen detected by oxygen detector 95). More significantly, because the integrity of the seal arrangement can be monitored and its functioning assured oxygen can be detected in inner cover vent line 98. If oxygen is detected in furnace atmosphere, and the seals are functioning, then it is known that the failure has occurred in the structural integrity of inner cover 26. That is, one of the welds in forming inner cover 26 or frusto conical wall portion 38, developed a crack. This significantly reduces the procedures now employed to determine where leaks are occurring in inner cover 26 and complete leak checking can be made part of every cycle.

As noted above, the seal arrangement of the present invention can be employed in existing, conventional inner cover designs, but the inner cover configuration shown in FIG. 3 is preferred. An alternative application of seal 80 is disclosed in the application shown in FIGS. 5 and 6 and the same reference numerals used to describe the parts and the arrangement discussed above for FIGS. 2, 3 and 4 will apply where applicable, to the arrangement shown in FIGS. 5 and 6. The FIGS. 5 and 6 embodiment is directed to an improved water cooling arrangement which takes the place of the water jacket, hose coupling arrangement described with reference to FIG. 3 and to a simpler, ring-type clamp mechanism. Configuration of seal 80 is identical for all embodiments. However, cylindrical bottom wall portion 39 rests on base 22. Thus, the inner cover application in FIG. 6 has the weight of inner cover 26 supported on base 22. Again, the effectiveness of the seal arrangement of the present invention is not affected because of the vacuum pulled in underpressure chamber 88 and the positive pressure applied to overpressure chamber 84.

Referring now to FIGS. 5 and 6 there is shown an additional enhancement for use when the seal arrangement is applied to batch coil annealing furnaces which permits water cooling of the elastomer seal without the use of any water hoses and hose connections. (The embodiment disclosed in FIGS. 3 and 4 used conventional, hose-type water jacket connections.) As those skilled in the art know, whenever inner cover 26 is secured to base 22, the water cooling connections are made by hoses under plant line pressure, typically about 40 PSI, through hose connections to inner covers 26. Hose connections have to be made when the inner covers are mounted to the base and then taken apart when inner covers 26 are removed from base 22. Leaks typically occur. The problem becomes more exasperating for multi-stand batch annealers where it becomes difficult to selectively make the connections to allow any specific cover to be removed, etc. The problem is severe enough in multi-stand annealers that prudent mills will not use a hydrogen atmosphere because of the potential for seal failure because of coolant leaks.

My invention also contemplates a hoseless, connector-less water cooling arrangement which can be applied to single stand or multi-stand batch coil annealing furnaces. In FIG. 5, a multi-stand batch coil annealing furnace is schematically illustrated by reference numeral 110 and four (4) inner covers **26*a*, 26*b*, 26*c* and 26*d* are schematically illustrated. Within base 22 is a fixed water manifold arrangement schematically illustrated by reference numeral 112. Water manifold 112 feeds a plurality of water spray jet nozzles 113. Jet nozzles 113 can be mounted to a cylindrical wall brace 114 which surrounds or circumscribes each inner cover 26 but is spaced radially outwardly from inner cover cylindrical wall portion 39 so that no contact is made between inner cover 26 and jet nozzle 13. Each inner cover 26 is simply lifted off and set on base 22 with a crane in a conventional manner. However, when any inner cover 26 is set onto base 22, the hoseless water cooling arrangement of the present invention can be operated. Nozzles 113 are spaced at circumferential increments about wall brace 114 so that their water sprays insure uniform flow of water over the entire area of elastomer seal 80. In FIG. 5 there are shown eight (8) water jet nozzles 113 for each cooling cover 26 although any convenient number can be used. Further, jet nozzles 113** are sized and the geometry of the arrangement is such that relatively low water pressure, in the neighborhood of about 5 PSI, can be used.

Referring now to FIG. 6, sealing flange 116 of inner cover 26 includes the annular top plate 54, a first inner cylindrical skirt 117 extending from top plate 54 and generally adjacent cylindrical wall portion 39 and a first outer cylindrical skirt 118 positioned radially outwardly from first inner skirt 117 and extending from top plate 54. Thus, top plate 54, first inner skirt 117, and first outer skirt 118 define an annular recess 120 which may be viewed as U-shaped in cross section. Within U-shaped recess 120 is contained the clamp mechanism for clamping elastomer seal 80 and a water jacket for cooling elastomer seal 80. The water jacket conceptually includes a plurality of water inlet opening 122 formed in first outer skirt 118 at circumferentially spaced increments thereabout so that each water inlet opening 122 aligns with a specific water jet nozzle 113, but is spaced at some inward radial distance therefrom. Also, the water jacket includes a plurality of water outlet openings in first outer skirt 118 but at a point removed from inlet openings 122, preferably near the bottom of first outer skirt 118. The size and position of water outlet openings 123 is dictated by gravity, water flow rates, etc. However, the underpinning of this aspect of this invention is that water will spurt or shoot from water nozzle tubes 113 and flow through inlet openings 122 without any hose connections and the water will flow into and fill a water jacket and will travel through the water jacket thus cooling elastomer seal 80 to outlet openings 123 and then eventually through a drain in base 22 (not shown). This then permits the inner covers to be simply set onto base 22 and the coolant applied without having to make any hose connections, etc. Inner cover 26 will, of course, have to be positioned in rotational alignment with water nozzle tubes 113 when it is seated on base 22. This can be readily accomplished, for instance, by slotting in a V-shaped manner, wall brace 114 which could receive fins (not shown) extending from bottom cylindrical wall portion 39 of inner cover 26 which would then guide inner cover 26 into rotational alignment of inlet opening 122 with water nozzles 113 since they are spaced at equal circumferential increments. Other alignment schemes will suggest themselves to those skilled in the art. This concept, developed for elastomer seal 80, can be used in prior art seal arrangements such as those shown in FIGS. 1 and 1A. However, when used with seal 80, multi-stand annealing furnaces 110 can now safely use a hydrogen annealing atmosphere.

The specific water jacket configuration shown in FIG. 6 includes an annular bottom plate 124 generally parallel to top plate 54, a second inner skirt 125 extending from bottom plate 124 and generally adjacent first inner skirt 117 and a second cylindrical outer skirt 126 also extending from bottom plate 124 and generally adjacent first outer skirt 118. Thus, the water jacket in recess 120 has a U-shaped cross-sectional configuration with the bottom of skirts 117, 118 and 125, 126 closed to define a closed water jacket. In order to insure the correct flow of the coolant through the water jacket, an L-shaped baffle plate 128 is employed. L-shaped baffle plate 128 is orientated as shown so that its annular base portion 129 is parallel to top and bottom plates 54, 124 and its cylindrical leg portion 130 is in-between first and second inner skirts 117, 125. This insures that the water flow, as shown by the arrows in FIG. 6, will flow in the path indicated from water inlet openings 122 to water outlet openings 123. Finally, conventional insulation 132, such as Kaowool, is provided about top plate 54 and first inner skirt 117 from inner cover cylindrical wall portion 39 to prevent hot spots from forming which could otherwise detrimentally affect the cooling action of the water.

Also, illustrated in FIG. 6 is a modification to the clamp mechanism. In the embodiment of the invention illustrated in FIG. 6, a top inner ring 133 and a top outer ring 134 are permanently affixed to bottom plate 124 and second inner and outer skirts 125, 126 respectively. Moveable bottom inner ring 136 and moveable bottom outer ring 137 rests on adjustable set screws 140 which are rotated to clamp elastomer seals between top and bottom ring blocks 133, 134 and 136, 137 respectively. Second inner and outer skirts are then marked or scribed with measuring lines which allow set screws 140 to precisely compress seal 80 adjacent seal's inner and outer edge portions 81, 82. The adjustable screws 140 and rings 136, 137 provide a somewhat easier assembly than that described for FIG. 3.

Figure 7:
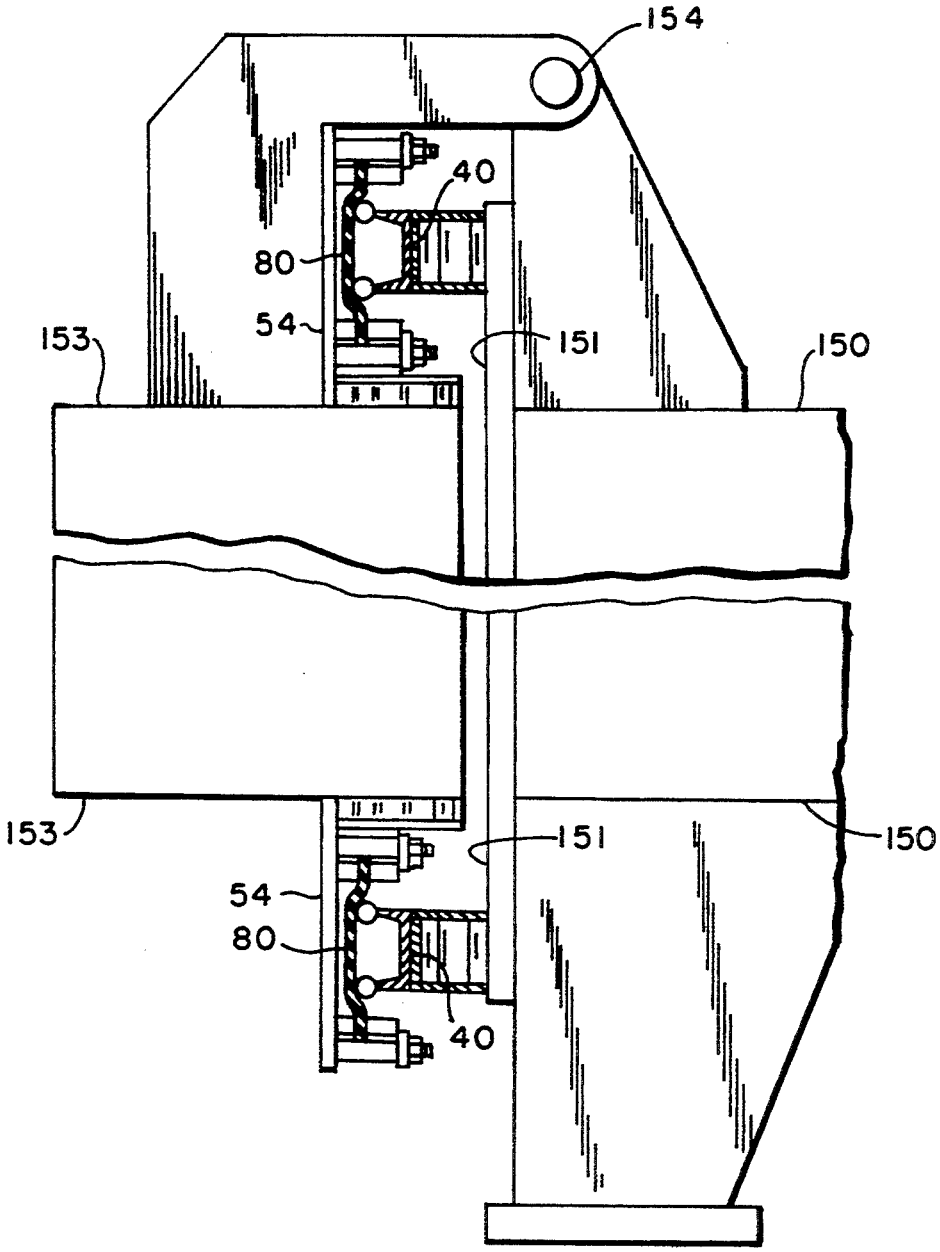
FIG. 7 is a schematic, partially broken away plan view of a heat treat furnace fitted with the seal of the present invention.

The invention has been specifically developed and has specific and unique application as a seal for bell-shaped, batch coil annealing furnaces and particularly, the batch coil annealing applications in which an explosive atmosphere such as hydrogen is employed. However, in accordance with the broader concept of the invention, those skilled in the art will recognize that the seal can be used for a variety of industrial furnaces having any kind of configuration and any orientation of elastomer seal 80, i.e., horizontal or vertical or inclined. This is generically illustrated in FIG. 7 in which an industrial furnace, such as a heat treat furnace (vacuum or standard atmosphere), is defined by a gas-tight housing 150 containing a gas tight chamber. Gas-tight housing 150 has an opening 151 typically at one end thereof in which work, i.e., metal parts, is placed for heating. A closure or an abutment member 153 is provided for closing opening 151. Typically, closure or abutment member 153 comprises a door hinged as at 154 to gas-tight housing 150. Opening 151 can be any shape, but typically is circular. Elastomer membrane seal 80 which is shaped as a flat, single ribbon strand circumscribes or surrounds opening 151. Elastomer membrane seal 80 can be clamped to either closure member 153 or gas-tight housing 150. If elastomer seal 80 is clamped to closure member 153 as shown in FIG. 7, then the support assembly 40 is formed on gas-tight housing 150 and the lower pressure $P_2$ will be drawn through support assembly 40. Alternatively, if elastomer seal 80 is clamped to gas-tight housing 150, then support assembly 40 will be formed on closure member 153 and the lower pressure drawn through closure member 153. (Note that seal 80 could be similarly reversed for the batch coil annealing furnace so that seal 80 will be clamped to base 22 and sealing engaging surfaces 50, 51 would be formed on inner cover 26.) The seal arrangement will then work as described above with the lower pressure at $P_2$ being lower than the pressure within gas-tight housing 150. Also, conventional water cooling jackets will be applied to closure member 153 and the flange of gas-tight housing 150.

The invention has been described with reference to a preferred and an alternative embodiment. Modifications will occur to others upon reading and understanding the detailed description set forth above. It is intended to include all such modifications and alterations insofar as they come within the scope of the present invention.

Having thus defined the invention, it is claimed:

1. A batch coil annealing furnace comprising an annular base plate having an upright annular channel formed therein;

an inner cover having a cylindrical sidewall with an open base and a top plate extending radially outwardly from said side wall and adjacent said cover's base;

an outer cover receiving said inner cover, said outer cover and inner cover resting on said base;

an annular elastomer membrane seal having an inside edge and an outside edge; clamp means associated with said top plate for clamping said seal adjacent its inner and outer edges to form a first overpressure chamber between said top plate and said membrane seal; first valve means in fluid communication with said overpressure chamber for injecting an inert gas into said overpressure chamber at a first pressure, $P_1$;

said upright channel having exposed seal engaging edges adapted to contact the underside of said seal when said inner cover rests on said base and forming a second pressure chamber with said seal, second valve means in fluid communication with said second pressure chamber for placing said second pressure chamber at a second pressure, $P_2$; and means to regulate said pressures to insure that said first pressure, $P_1$, is at a higher pressure than said second pressure, $P_2$, to maintain said membrane seal in sealing contact with said seal engaging edges.

2. The batch coil annealing furnace of claim 1 further including third valve means in fluid communication with the interior of said inner cover for maintaining said inner cover at a third pressure, $P_3$.

3. The batch coil annealing furnace of claim 2 wherein said first pressure, $P_1$, is higher than said third pressure, $P_3$, and said third pressure, $P_3$, is at a higher pressure than said second pressure, $P_2$.

4. The batch coil annealing furnace of claim 3 wherein said second pressure, $P_2$, is at vacuum to insure sealing of said membrane seal with said upright engaging edge.

5. The batch coil annealing furnace of claim 1 further including stop means associated with said base of said inner cover for maintaining the height of said upright channel at a fixed distance relative to said top plate when said inner cover rests on said base for distending said membrane seal over said seal engaging edges when said inner cover rests on said base whereby sealing of said membrane seal with said channel is assured when said overpressure chamber is pressurized.

6. The batch coil annealing furnace of claim 1 further including a first water jacket in heat transfer contact with said top plate for cooling said membrane seal and a second water jacket in said base in heat transfer contact with said channel for cooling said membrane seal.

7. The batch coil annealing furnace of claim 6 further including insulation about said inner cover adjacent said membrane seal for maintaining said seal at a constant temperature gradient in relation to the temperature of said inner cover.

8. The batch coil annealing furnace of claim 2 further including a vacuum pump in fluid communication through a conduit with said second pressure chamber; pressure sensing means for sensing said pressure of said inert gas in said overpressure chamber and control fail safe means operated by said pressure sensing means to signal a failed condition while pumping said inert gas into said overpressure chamber to maintain pressure therein thus forcing said inert gas into said inner cover.

9. The batch coil annealing furnace of claim 1 wherein said clamp means includes an inner and an outer concentric, circular bottom plate, each bottom plate having a plurality of openings, a threaded stud extending through each opening for threaded engagement with said top plate, each stud receiving a sleeve clamped between said top and bottom plate whereby said bottom plate is maintained a spaced distance from said top plate;

a cylindrical top inner clamp plate having an annular edge affixed to said top plate and a similar bottom inner clamp plate having an annular edge affixed to said inner bottom plate, said membrane seal's inner edge clamped between said bottom and top inner clamp plates, the height of both said top and bottom inner clamp plates being slightly less than the length of said sleeves whereby said membrane seal is distended in a non-shearing manner between the edges of said top and bottom inner clamp plates; and a cylindrical top outer clamp plate having an annular edge affixed to said top plate and a similar bottom outer clamp plate having an annular edge affixed to said outer bottom plate, said membrane seal's outer edge clamped between said bottom and top outer clamp plates, the height of both said top and bottom outer clamp plates being slightly less than the length of said sleeves whereby said membrane seal is distended in a non-shearing manner between the edges of said top and bottom outer clamp plates.

10. The batch coil annealing furnace of claim 1 further including a source of pressurized, substantially inert gas;

a vacuum pump;

first conduit means in valved fluid communication with said overpressure chamber and said inert gas source, and with the interior of said inner cover;

pressure sensing means sensing the pressure of said inert gas in said overpressure chamber;

second conduit means in valved fluid communication with said second pressure chamber and said vacuum pump;

means for sensing the presence of oxygen in said second pressure chamber; and microprocessor control means permitting flow of said inert gas into said overpressure chamber when said pressure sensing means falls below a preset pressure whereby oxygen is prevented from leaking into said inner cover.

11. The batch coil annealing furnace of claim 10 wherein said microprocessor control means, in response to actuation of said oxygen detection means, increases the vacuum drawn in said second pressure chamber and in response to the pressure sensed in said overpressure chamber discerns if a leak has occurred within said inner cover and shuts down said furnace.

12. The batch coil annealing furnace of claim 11 further including said second conduit means in valved communication with said vacuum pump and said inner cover and said oxygen detector means further sensing the presence of oxygen within said inner cover.

13. The batch coil annealing furnace of claim 1 further including water cooling means for maintaining said elastomer seal at a non-destructive temperature.

14. The batch coil annealing furnace of claim 13 wherein said inner cover has a cylindrical sidewall, said inner cover flange includes an annular top plate, a first inner cylindrical skirt extending from said top plate generally adjacent said sidewall and a first outer cylindrical skirt positioned radially outwardly from said inner cover and extending from said top plate, said top and said inner and outer skirts defining an annular U-shaped recess;

clamp means within said U-shaped recess for sealingly gripping said seal adjacent its inner and outer edges;

water jacket means within said U-shaped recess for containing a water coolant adjacent said seal, said water jacket means including said inner and outer skirts, said outer skirt having a plurality of circumferentially spaced inlet openings generally adjacent said top plate and a plurality of outlet openings removed from said inlet openings;

said water cooling means including a water manifold in said base circumscribing said inner cover flange and a plurality of water jet nozzles extending from said manifold, each water jet nozzle aligned with an inlet opening but spaced radially outwardly therefrom whereby water as a low pressure jet from said nozzle enters said water jacket means through said inlets and exits through said outlet for cooling said seal without any hose connections from said water manifold to said inner cover.

15. The batch coil annealing furnace of claim 14 wherein said water jacket means forms, in cross-sectional configuration, a U-shaped water jacket and includes a second inner cylindrical skirt adjacent said first inner cylindrical skirt defining an inner leg of said U-shaped water jacket, a second outer cylindrical skirt adjacent said first outer cylindrical skirt defining an outer leg of said U-shaped jacket, and an annular bottom plate defining with said top plate the base of said U-shaped jacket, said water jacket further having an annular baffle in the cross-sectional configuration of an "L" with the base of said "L" shaped baffle in-between said bottom and top plates and the leg of said "L" shaped baffle in-between said first and second inner skirts whereby the water path is forced from said inner leg to said outer leg by gravity flow to assure uniform cooling of said seal.

16. The batch coil annealing furnace of claim 15 wherein said batch coil annealing furnace includes a base for carrying a plurality of inner covers and said water manifold surrounds each inner cover.

17. In a batch coil annealing furnace having an inner cover with a cylindrical sidewall and an open bottom, an outer cover, and an annular base upon which said bottom of said inner cover and said outer cover rest in a removable manner, the improvement comprising:

a) an annular top plate adjacent said bottom of said inner cover and extending radially outwardly from said inner cover's sidewall;

b) first and second generally circular clamps concentric with one another and extending downwardly from said top plate;

c) an annular, elastomer membrane seal clamped between said first and second clamps, said seal, clamps and top plate defining a sealed overpressure chamber; valve means in fluid communication with said overpressure chamber for introducing a source of inert gas at a pressure into said overpressure chamber; and d) first and second circular supports extending upwardly from said base and terminating in seal engaging edges, said first support spaced radially outwardly from said first clamp and said second support spaced radially inwardly from said second clamp and forming an upright annular chamber therebetween with the underside of said membrane seal when said inner cover rests on said base.

18. The improvement of claim 17 wherein said membrane seal, said first and second supports and said base define a sealed annular underpressure chamber and second valve means in fluid communication with said underpressure chamber for maintaining said underpressure chamber at a pressure less than that present in said overpressure chamber whereby said seal is forced into sealing engagement with said seal engaging edges of said uprights.

19. The improvement of claim 18 further including a vacuum pump in fluid communication through a conduit with said underpressure chamber; oxygen detecting means in said conduit and control means actuated in response to oxygen detection in said conduit to increase the pressure of said inert gas.

20. The improvement of claim 18 further including a base support associated with said inner cover for contacting said base and supporting said inner cover after said seal engaging edges have contacted said seal and distended same.

21. The improvement of claim 18 further including water jacket conduit means associated with said top plate for circulating a coolant therein and cooling said membrane seal.

22. The improvement of claim 21 further including second water conduit cooling means in said base adjacent said second chamber for circulating a coolant therein and cooling said membrane seal.

23. The improvement of claim 22 further including insulation secured to said inner cover adjacent said membrane seal for maintaining a uniform temperature gradient within said cover.

24. The improvement of claim 18 wherein said first and second clamps include an inner and an outer concentric, circular bottom plate, each bottom plate having a plurality of openings, a threaded stud extending through each opening for threaded engagement with said top plate, each stud receiving a sleeve clamped between said top and bottom plate whereby said bottom plate is maintained a spaced distance from said top plate;

a cylindrical top inner clamp plate having an annular edge affixed to said top plate and a similar bottom inner clamp plate having an annular edge affixed to said inner bottom plate, said membrane seal's inner edge clamped between said bottom and top inner clamp plates, the height of both said top and bottom inner clamp plates being slightly less than the length of said sleeves whereby said membrane seal is distended in a non-shearing manner between the edges of said top and bottom inner clamp plates; and a cylindrical top outer clamp plate having an annular edge affixed to said top plate and a similar bottom outer clamp plate having an annular edge affixed to said outer bottom plate, said membrane seal's outer edge clamped between said bottom and top outer clamp plates, the height of both said top and bottom outer clamp plates being slightly less than the length of said sleeves whereby said membrane seal is distended in a non-shearing manner between the edges of said top and bottom outer clamp plates.

25. An industrial furnace comprising:

a) a gas tight housing member having an opening through which work to be heated is placed;

b) means for closing said opening including an abutment member adapted to seat against said gas tight housing member;

c) a flat, continuous elastomer seal circumscribing said opening and adapted to be positioned between said abutment and said housing members, said seal having inner and outer peripheral edges, said seal being sealingly affixed adjacent its edges to one of said housing and abutment members and the other one of said housing and abutment member having a seal engaging surface protruding therefrom; and d) pressure means subjecting one side of said seal to a first pressure and the other side of said seal to a lower second pressure whereby said opening is sealed by distending said seal as a result of the pressure differential between said first and second pressures into sealing engagement with said seal engaging surface on the other one of said housing and abutment members.

26. The furnace of claim 25 wherein said furnace is a heat treat furnace; said abutment member is a door in hinged contact with said housing, said pressure means effective to maintain said second pressure lower than the pressure in said housing member.

27. The furnace of claim 25 wherein said furnace is a batch coil annealing furnace, said housing member being the inner cover of said batch coil annealing furnace, and said abutment member comprising the base of said batch coil annealing furnace.

28. The furnace of claim 27 wherein said inner cover has an annular flange, said elastomer seal being annular in configuration and affixed to said flange and defining between the flange and the side of said elastomer seal facing said flange a first pressure chamber, said base having an annular channel extending therefrom and forming a passage therein, said passage and the side of said elastomer seal facing said annular channel forming a second pressure chamber, said pressure means effective to maintain said second pressure chamber at a lower pressure than said first pressure chamber.

29. The furnace of claim 28 wherein said pressure means is effective to maintain said second pressure chamber at a lower pressure than the pressure within said inner cover.

30. The furnace of claim 28 further including water cooling means for maintaining said elastomer seal at a non-destructive temperature.

31. The furnace of claim 30 wherein said inner cover has a cylindrical sidewall, said inner cover flange includes an annular top plate, a first inner cylindrical skirt extending from said top plate generally adjacent said sidewall and a first outer cylindrical skirt portioned radially outwardly from said inner cover and extending from said top plate, said top and said inner and outer skirts defining an annular U-shaped recess;

clamp means within said U-shaped recess for sealingly gripping said seal adjacent its inner and outer edges;

water jacket means within said U-shaped recess for containing a water coolant adjacent said seal, said water jacket means including said inner and outer skirts, said outer skirt having a plurality of circumferentially spaced inlet openings generally adjacent said top plate and a plurality of outlet openings removed from said inlet openings;

said water cooling means including a water manifold in said base circumscribing said inner cover flange and a plurality of water jet nozzles extending from said manifold, each water jet nozzle aligned with an inlet opening but spaced radially outwardly therefrom whereby water as a low pressure jet from said nozzle enters said water jacket means through said inlets and exits through said outlet for cooling said seal without any hose connections from said water manifold to said inner cover.

32. The furnace of claim 31 wherein said water jacket means forms, in cross-sectional configuration a U-shaped water jacket and includes a second inner cylindrical skirt adjacent said first inner cylindrical skirt defining an inner leg of said U-shaped water jacket, a second outer cylindrical skirt adjacent said first outer cylindrical skirt defining an outer leg of said U-shaped jacket, and an annular bottom plate defining with said top plate the base of said U-shaped jacket, said water jacket further having an annular baffle in the cross-sectional configuration of an "L" with the base of said "L" shaped baffle in-between said bottom and top plates and the leg of said "L" shaped baffle in-between said first and second inner skirts whereby the water path is forced from said inner leg to said outer leg by gravity flow to assure uniform cooling of said seal.

33. The furnace of claim 32 wherein said clamp means includes an upper inner ring adjacent said second inner skirt and said bottom plate, an upper outer ring adjacent said second outer skirt and said bottom plate, a lower inner ring adjacent said second inner skirt, a lower outer ring adjacent said second outer skirt, and adjustable set screws in contact with said lower rings for compressing said seal between said upper and lower rings.

34. The furnace of claim 31 wherein said batch coil annealing furnace includes a base for carrying a plurality of inner covers and said water manifold surrounds each inner cover.

35. In a batch coil annealing furnace having a base, an inner cover with a flange extending radially outwardly therefrom, a seal between said flange and said base for sealing said inner cover to said base the improvement comprising:

an annular water jacket formed in said flange and extending about said seal, a first plurality of inlet openings circumferentially spaced about said flange in fluid communication with said water jacket, a plurality of outlet openings positioned vertically below said water inlets in fluid communication with said water jacket;

a first plurality of water jet nozzles circumscribing said flange and spaced circumferentially about said flange at the same increments as said inlet openings, said nozzles extending radially outwardly from said flange and aligned with said inlet openings when said inner cover is seated on said base; and water supply means for causing water to flow as jet streams from said nozzles through said water inlets into said water jacket for cooling said seal.

36. The batch coil annealing furnace of claim 35 wherein said inner cover has a cylindrical sidewall, said inner cover flange includes an annular top plate, a first inner cylindrical skirt extending from said top plate generally adjacent said sidewall and a first outer cylindrical skirt positioned radially outwardly from said inner cover and extending from said top plate, said top and said inner and outer skirts defining an annular U-shaped recess;

clamp means within said U-shaped recess for gripping said seal; and said water jacket including said inner and outer skirts, said outer skirt having said inlet openings generally adjacent said top plate and said outlet openings removed from said inlet openings.

37. The batch coil annealing furnace of claim 36 wherein said water jacket forms, in cross-sectional configuration, a U-shaped water jacket and includes a second inner cylindrical skirt adjacent said first inner cylindrical skirt defining an inner leg of said U-shaped water jacket, a second outer cylindrical skirt adjacent said first outer cylindrical skirt defining an outer leg of said U-shaped jacket, and an annular bottom plate defining with said top plate the base of said U-shaped jacket, said water jacket further having an annular baffle in the cross-sectional configuration of an "L" with the base of said "L" shaped baffle in-between said bottom and top plates and the leg of said "L" shaped baffle in-between said first and second inner skirts whereby the water path is forced from said inner leg to said outer leg by gravity flow to assure uniform cooling of said seal.

38. The batch coil annealing furnace of claim 37 wherein said batch coil annealing furnace includes a base for carrying a plurality of inner covers and said water manifold surrounds each inner cover.

* * * * *